US006224286B1

(12) United States Patent
Villahoz

(10) Patent No.: US 6,224,286 B1
(45) Date of Patent: May 1, 2001

(54) CREAM APPLYING DEVICE FOR FOOTWEAR

(76) Inventor: Inmaculada Nieto Villahoz, Paseo Ondarreta, 5-2° C. San Sebastian (ES)

( * ) Notice: Subject to any disclaimer, the term of this patent is extended or adjusted under 35 U.S.C. 154(b) by 0 days.

(21) Appl. No.: 09/442,701

(22) Filed: Nov. 18, 1999

(30) Foreign Application Priority Data

May 19, 1999 (ES) ..... 9901077

(51) Int. Cl.[7] ..... B43M 11/02

(52) U.S. Cl. ..... 401/219; 401/281

(58) Field of Search ..... 401/208, 219, 401/270, 280, 281

(56) References Cited

U.S. PATENT DOCUMENTS 4,150,904 * 4/1979 Stewart ..... 401/186
6,010,264 * 1/2000 Scuderi et al. ..... 401/21

* cited by examiner

*Primary Examiner*—Gregory L. Huson
*Assistant Examiner*—Peter deVore
(74) *Attorney, Agent, or Firm*—Fulwider Patton Lee & Utecht, LLP

(57) ABSTRACT

Cream applier device for footwear, including a container (1), closed at one of its ends and the other having a closing cap (4), equipped with a product outlet conduit, over which a hood shaped part (2) is fitted, which rotates over the container, matching or not an outlet conduit (21) with the hole in the cap (4), to direct product opening or closing towards a spongy component consisting of a roller (3), rotating around a horizontal axis (5) assembled over two opposite knobs defined in the hood part (2).

4 Claims, 1 Drawing Sheet

CREAM APPLYING DEVICE FOR FOOTWEAR

This invention as its title indicates refers to a container with a liquid shoe cleaning product, cream or paste, and more specifically, a device fitted in the container mouth permitting the product to be dosed and applied, spreading it over the footwear leather surface or that of similar products.

Devices with these characteristics consist of a spongy component fitted in the lid, having a central hole through which the shoe polish or cream passes, and is spread by moving the sponge over the leather. These devices are well known in the market but defects in their use since a good lubrication of the footwear is not obtained until the sponge has been sufficiently impregnated with the product. Once the latter occurs, surpluses of product are formed preventing its correct application, in most cases even dripping, since the sponge is unable to absorb any more product.

Normally these devices have a closing cap with a protruding nipple matching the outlet, such that when the container is new and has not been used several times, it permits the outlet to be plugged when the doser is not in use.

The device of this invention has a double purpose: on the one hand, to obtain an applier which in a single sweep, uniformly impregnates the surface with the product, even when the latter is very fluid and, on the other, to give the applier a means of closing which controls the exit of the product independently from the container being inclined over the footwear.

For this purpose, starting from a container of any shape, preferably cylindrical, closed at one of its ends and having a closing cap at the other, equipped with an outlet for the product, over which a kind of hood is fitted which being pressed on the open end of the container may be rotated and defines an outlet conduit for the product located sideways, such that together with an also side arrangement of the outlet hole in the cap, on rotating this hood the product outlet opens or not, towards the spongy component fitted inside the hood.

With respect to the spongy component, in this invention it is a roller which rotates around a horizontal axis, fitted over two knobs opposite each other incorporated in the hood itself, having between theme an undercutting or cylindrical cavity, matching said spongy component, in which the product outlet opens. In this cylindrical cavity and with the purpose of preventing, in spite of the applier being equipped with a means of closing, the product leaving in excess flooding the applying sponge, two excess products channels have been incorporated in said cavity along both sides of the exit conduit, which in the case of excessive flooding, for example, as a result of having pressed the container too strongly, part of the product remains deposited on both channels and as a result the spongy component does not drip.

In the base of the container of this applier, there are some radial knobs which acts as a stop, defining the rotation angle of the hood together with its inside shape.

The purpose of this invention will be understood better, by means of the following description based on a simple practical execution. This description is made using the attached drawings, which:

FIG. 1 shows a general elevation view of a container equipped with the applier of this invention.

With an angle of 90° with respect to the above,

Figure 2:
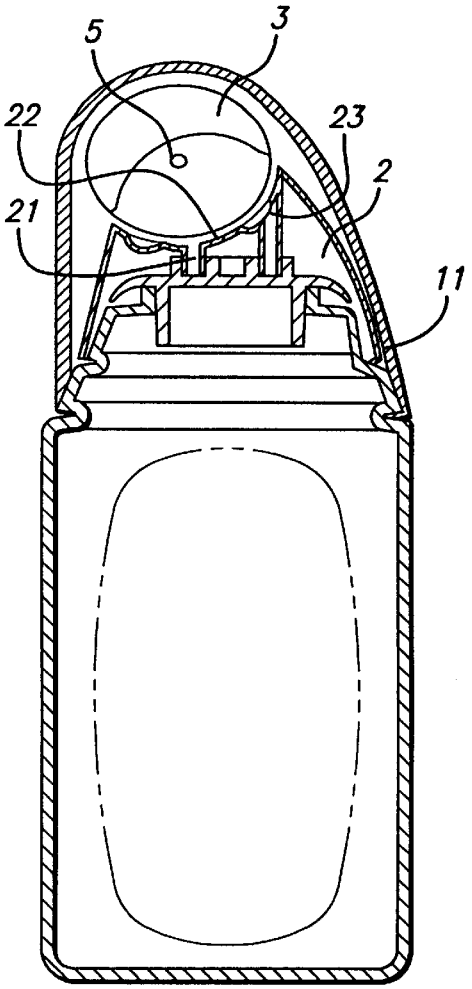
FIG. 2 shows an elevation view, in this case following a diametric cross-section.
Figure 1:
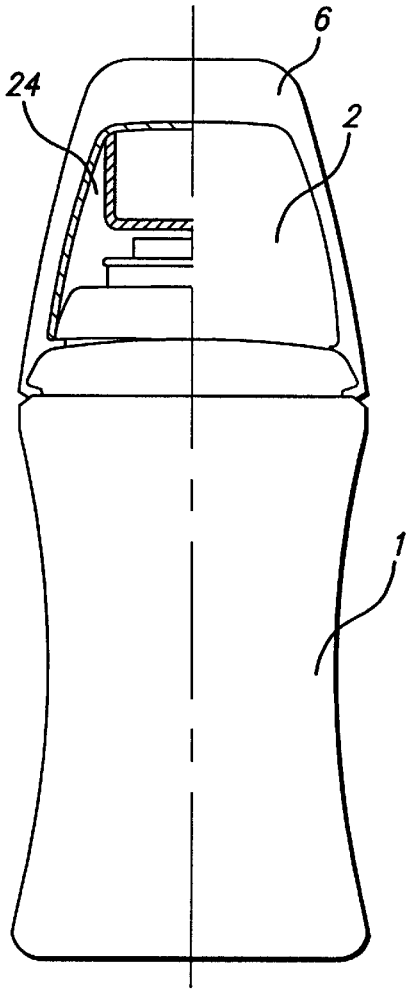
Figure 3:
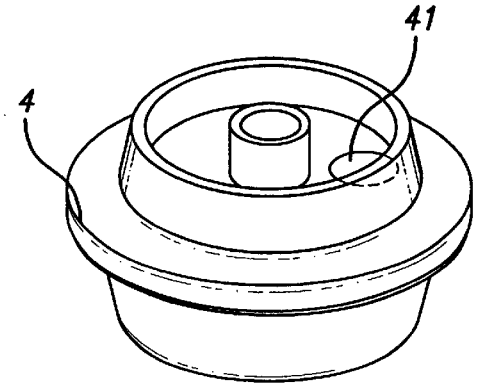
FIG. 3 shows a detailed perspective view of the cap (4) fitted in the container (1).

The cream applying device for footwear, purpose of this invention, includes a container (1 of any shape although preferably cylindrical, closed at one of its ends, whilst the other has a mouth closed by a cap (4) shown in detail in FIG. 3. At this end of the container (1), there are a series of steps on the outside which permit the fitting under pressure over them of a hood shaped part (2), over which the spongy component (3) is assembled, allowing the cream to be spread over the footwear, as well as a hood (6) whose sole purpose is to protect the container during transport and deposit.

The applying device itself consists of a part (2) having the shape of a hood, pressing the open base of the container (1) and with the possibility of rotating at least in a determined angle. This part (2) defines a conduit (21) to direct the product from the closing cap (4) to the external surface (22) in which the spongy component (3) is located. The closing cap (4) has a hole (41) displaced sideways to make it matchthe conduit (2) in a determined position, hence establishing by means of rotation of the hood (2) the exit or not of the product towards the spongy component (3).

The spongy component consists of a roller (3) rotating around a horizontal axis (5) fitted over two knobs or lugs (24) formed by the hood (2), creating between them an undercutting or cylindrical cavity (22) matching said spongy component (3), over which the aforementioned product outlet conduit opens and which includes reference (21).

The mentioned cylindrical cavity (22), in which the applying roller (3) is located has an outlet conduit (21) directed towards the central zone, accompanied in both sides by two excess product collection channels (23) which act as temporary deposits if an excessive amount of product exists, to prevent the spongy component (3) from dripping.

At the end of the container, over which this device is fitted, there is at least one side stop (11), which together with the hood shape (2), allows a specific rotation angle of said hood to be established to more easily situated the opening and closing points of the outlet conduit (21), in spite of the fact that externally, the graphical location of the latter is indicated to help the consumer understand.

It is not considered necessary to extend this description further for any expert in the matter to understand the scope of the invention and the advantages derived thereof.

The terms in which this report has been prepared should always be construed in the widest and non-limiting sense.

The materials, shape and arrangement of the components may be varied provided it does not involve a change of the basic characteristics of the invention which are claimed below.

What is claimed is:

1. Cream applying device for applying a cream product to footwear, comprising:

a container (1), closed at one end, and the other end having a closing cap (4), equipped with a product outlet hole (41), terminating in a spongy component which is applied over the footwear impregnating it; a hood shaped part (2), having a surface defining a cavity (22), said spongy component being received in said cavity of said hood shaped part, said hood shaped part coupling under pressure in the open end of the container (1), permitting rotation of said hood shaped part, said hood shaped part having a conduit (21) to direct the product from the closing cap (4) to the cavity (22), in which the spongy component (3) is located; wherein said closing cap has an outlet hole (41) corresponding to the conduit (21), only in a determined position, thereby controlling exit of the product toward the spongy component (3) by rotation of the hood (2); and said surface of said hood shaped part further defining at least one excess product collection channel (23) in fluid communication with said cavity (22).

2. A device according to claim 1, wherein said spongy component consists of a roller (3) which rotates around a horizontal axis (5) fitted over two opposite knobs (24) defined by the hood shaped part (2).

3. A device according to claim 1, wherein said cavity (22) is a cylindrical cavity (22), in which the applier roller is located, and wherein said cylindrical cavity has a central zone, and said at least one excess product collection channel comprises two excess product collection channels (23) located on both sides of said product conduit (21).

4. A device according to claim 1, wherein said other end of the container in the zone corresponding to the exit has a stepped shape permitting the inclusion under pressure of the hood shaped part holding the applier component and a second protection hood fitted on the outside of said hood shaped part; and said other end of the container defining at least one radial stop (11) for limiting rotation of said hood shaped part.

* * * * *